US008080982B2

(12) United States Patent
Lin et al.

(10) Patent No.: US 8,080,982 B2
(45) Date of Patent: Dec. 20, 2011

(54) LOW DROP-OUT VOLTAGE REGULATOR WITH EFFICIENT FREQUENCY COMPENSATION

(75) Inventors: Ying-Yao Lin, Hsin-Chu (TW); Cheng-Chung Hsu, Hsin-Chu Hsien (TW)

(73) Assignee: PixArt Imaging Inc., Science-Based Industrial Park, Hsin-Chu (TW)

( * ) Notice: Subject to any disclaimer, the term of this patent is extended or adjusted under 35 U.S.C. 154(b) by 430 days.

(21) Appl. No.: 12/357,382

(22) Filed: Jan. 21, 2009

(65) Prior Publication Data

US 2010/0026252 A1 Feb. 4, 2010

(30) Foreign Application Priority Data

Aug. 4, 2008 (TW) ..... 97129503 A

(51) Int. Cl.
*G05F 1/565* (2006.01)

(52) U.S. Cl. ..... 323/275; 323/265; 323/273; 323/274

(58) Field of Classification Search ..... 323/273, 323/274, 275, 279, 280
See application file for complete search history.

(56) References Cited

U.S. PATENT DOCUMENTS

| | | | | |
|---|---|---|---|---|
| 5,686,821 | A * | 11/1997 | Brokaw | 323/273 |
| 6,420,857 | B2 * | 7/2002 | Fukui | 323/280 |
| 6,690,147 | B2 * | 2/2004 | Bonto | 323/280 |
| 7,088,082 | B2 * | 8/2006 | Jung | 323/275 |
| 2010/0052635 | A1 * | 3/2010 | Wang | 323/280 |

* cited by examiner

*Primary Examiner* — Adolf Berhane
*Assistant Examiner* — Lakaisha Jackson
(74) *Attorney, Agent, or Firm* — Winston Hsu; Scott Margo

(57) ABSTRACT

A low drop-out (LDO) voltage regulator with efficient frequency compensation is disclosed. The LDO voltage regulator includes an error amplifier, a transmission element, a voltage divider and a pole control unit. The error amplifier generates a control signal according to a reference voltage and a feedback voltage. The transmission element is coupled to the error amplifier, and adjusts an input voltage to generate an output voltage according to the control signal. The voltage divider is coupled to the transmission element, and performs a voltage division operation on the output voltage to generate the feedback voltage. The pole control unit is coupled to the transmission element, and provides and adjusts an output capacitor of the LDO voltage regulator to fix a frequency of a pole according to variation of an output impedance of the transmission element, so as to maintain loop stability.

9 Claims, 3 Drawing Sheets

LOW DROP-OUT VOLTAGE REGULATOR WITH EFFICIENT FREQUENCY COMPENSATION

BACKGROUND OF THE INVENTION

1. Field of the Invention

The present invention relates to a Low Drop-Out (LDO) voltage regulator with efficient frequency compensation, and more particularly, to a LDO voltage regulator that adjusts output capacitance to fix frequency of a pole according to current variation of a back-end load.

2. Description of the Prior Art

A linear voltage regulator has ability to provide a stable output voltage. A Low Drop-Out (LDO) linear voltage regulator is further able to generate an output voltage very close to an input voltage, so as to save power consumption of power transistors and increase battery life. Thus, the LDO voltage regulator is widely used in various portable electronic products, such as music players, digital cameras, mobile phones, notebook computers, and so on.

Please refer to FIG. 1, which shows a schematic diagram of a conventional LDO voltage regulator 10. The LDO voltage regulator 10 includes an error amplifier 110, a transmission element 120 and an output capacitor Cout, and mainly operates by utilizing a voltage divider 130 to generate a feedback voltage VFB for the error amplifier 110 to control the transmission element 120 according to difference between the feedback voltage VFB and a reference voltage VREF, so as to generate stable output voltages. Additionally, the output capacitor Cout is utilized for providing current temporarily required by a back-end load to improve transient response of the output voltage when load current $I_{load}$ of the back-end load is changed suddenly.

Generally, loop stability is an important issue in the design of the LDO voltage regulator. In a traditional circuit structure, the load current and the output capacitor are two major factors affecting the loop stability. By establishing a small signal circuit model of the above LDO voltage regulator, it can be found that the circuit loop mainly has two poles, which relate closely to the design of the loop stability. A dominant pole is generated by a parasitic capacitor formed between the error amplifier and the transmission element and output impedance of the error amplifier, and can be expressed as:

$$fp1 \approx \frac{1}{2\pi \times Roe \times Cpar},$$

in which Roe and Cpar represent the output impedance of the error amplifier and the parasitic capacitor between the error amplifier and the transmission element, respectively. A second pole is generated by the output capacitor and output impedance of the LDO voltage regulator, and can be expressed as:

$$fp2 \approx \frac{1}{2\pi \times Ro \times Cout} \approx \frac{\lambda \times I_{load}}{2\pi \times Cout},$$

in which Ro and λ represent the output impedance of the transmission element 120 and a channel length modulation coefficient, respectively.

As can be seen in the above, when the load current $I_{load}$ varies, frequency of the second pole will drift while the other pole remains unchanged. However, since the frequency drift may significantly change frequency response of the LDO voltage regulator, loop instability may occur due to insufficient phase margin in some situations.

In short, the LDO voltage regulator may suffer problems of loop instability when the load current varies.

SUMMARY OF THE INVENTION

It is therefore an objective of the present invention to provide a Low Drop-Out (LDO) voltage regulator with efficient frequency compensation.

According to the present invention, an LDO voltage regulator with efficient frequency compensation is disclosed. The LDO voltage regulator includes an error amplifier, a transmission element, a voltage divider and a pole control unit. The error amplifier is utilized for generating a control signal according to a reference voltage and a feedback voltage. The transmission element is coupled to the error amplifier, and is utilized for adjusting an input voltage to generate an output voltage according to the control signal. The voltage divider is coupled to the transmission element, and is utilized for performing a voltage division operation on the output voltage to generate the feedback voltage. The pole control unit is coupled to the transmission element, and is utilized for providing and adjusting output capacitance of the LDO voltage regulator to fix frequency of a pole according to variation of output impedance of the transmission element, so as to maintain loop stability.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
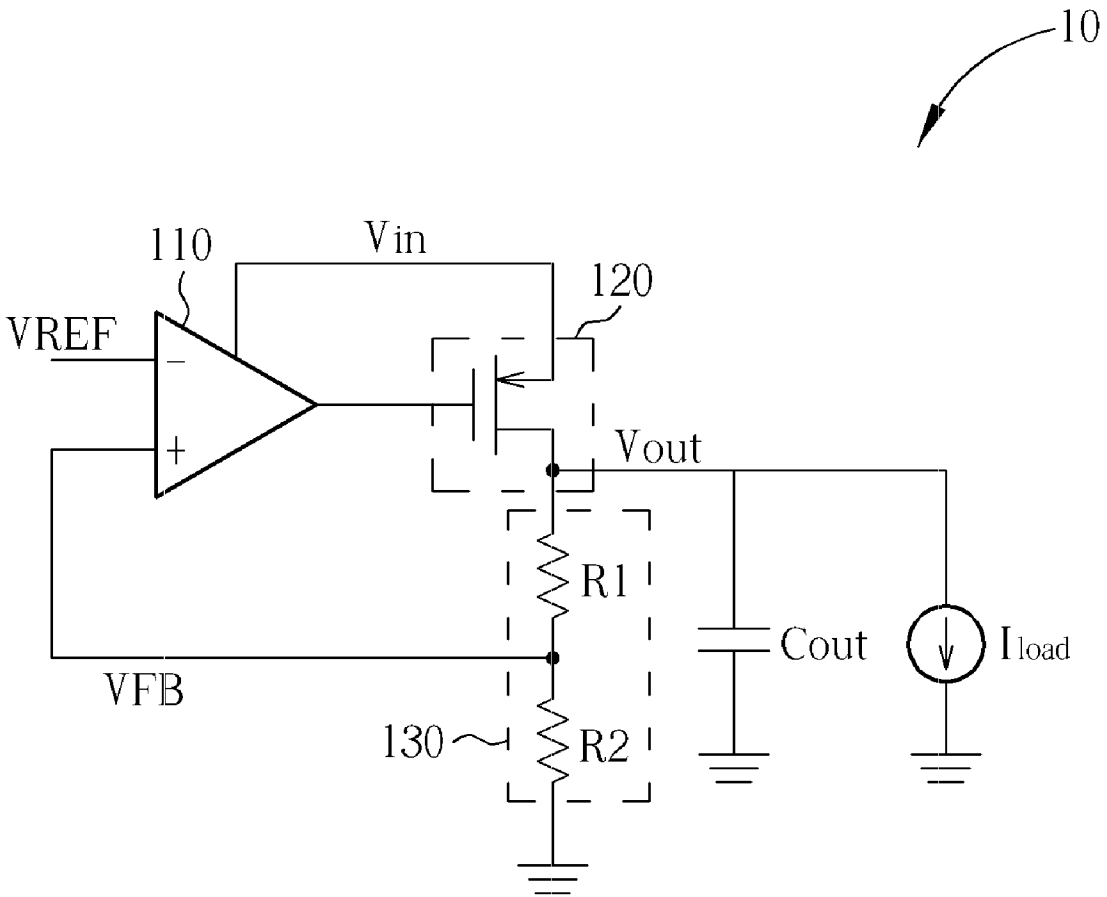
FIG. 1 PRIOR ART
FIG. 1 shows a schematic diagram of a conventional LDO voltage regulator.
Figure 2:
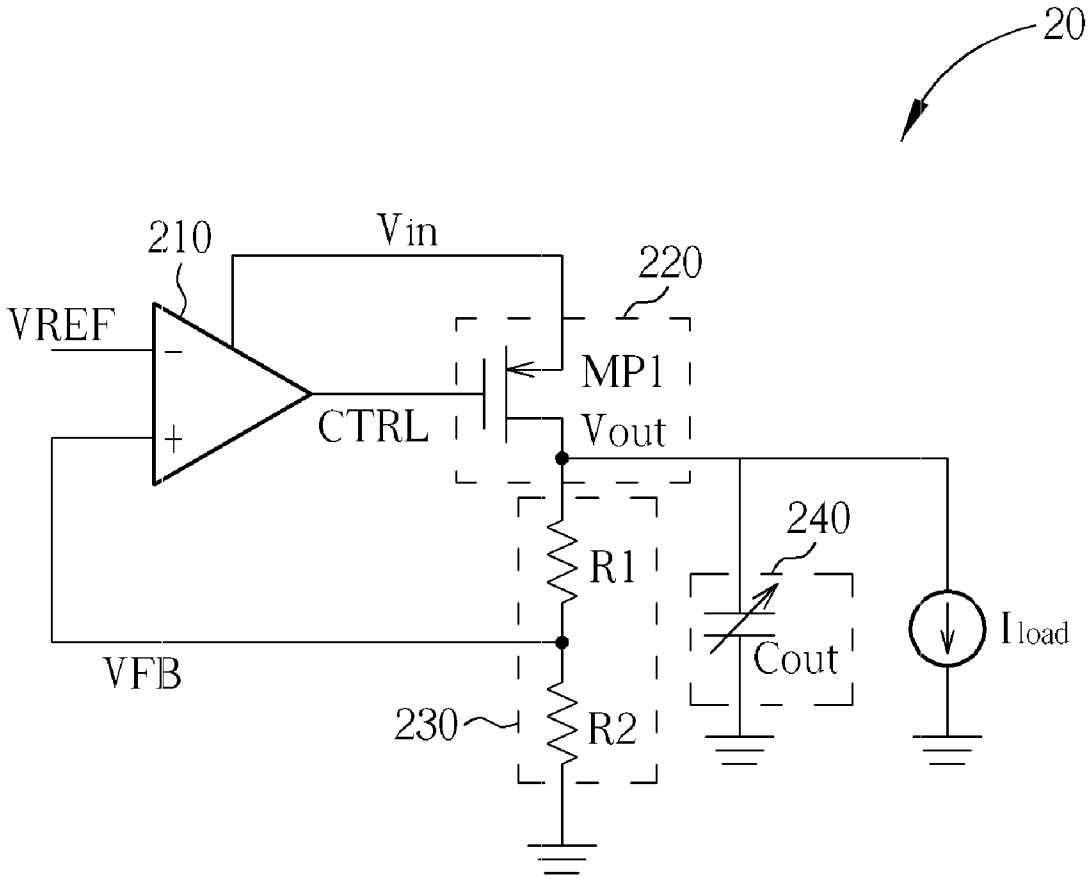
FIG. 2 is a schematic diagram of an LDO voltage regulator with efficient frequency compensation according to an embodiment of the present invention.

Please refer to FIG. 2. FIG. 2 is a schematic diagram of a Low Drop-Out (LDO) voltage regulator 20 with efficient frequency compensation according to an embodiment of the present invention. The LDO voltage regulator 20 includes an error amplifier 210, a transmission element 220, a voltage divider 230 and a pole control unit 240. The error amplifier 210 is utilized for generating a control signal CTRL according to a reference voltage VREF and a feedback voltage VFB. The transmission element 220 is coupled to the error amplifier 210, and is utilized for adjusting an input voltage Vin to generate an output voltage Vout according to the control signal CTRL. The voltage divider 230 is coupled to the transmission element 220, and is utilized for performing a voltage division operation on the output voltage Vout to generate the feedback voltage VFB. The pole control unit 240 is coupled to the transmission element 220, and is utilized for providing and adjusting an output capacitance Cout of the LDO voltage regulator to fix frequency of a pole according to variation of output impedance of the transmission element, so as to maintain loop stability. Preferably, the transmission element 220 can be realized by a P-type Metal-Oxide-Semiconductor (MOS) Field Effect Transistor (FET), while the voltage divider 230 can be realized by voltage dividing resistors R1 and R2, as shown in FIG. 2.

As described above, one pole of the LDO voltage regulator is decided by a product of the output impedance of the transmission element and the output capacitance. Thus, when the output impedance of the transmission element varies, such as when an operation state of a back-end load is changed, a conventional LDO voltage regulator may suffer loop instability due to drift of the pole frequency. Therefore, the LDO voltage regulator 20 utilizes the pole control unit 240 to adjust the output capacitance Cout for fixing the pole frequency according to the output impendence variation of the transmission element 220, so as to maintain the loop stability.

Figure 3:
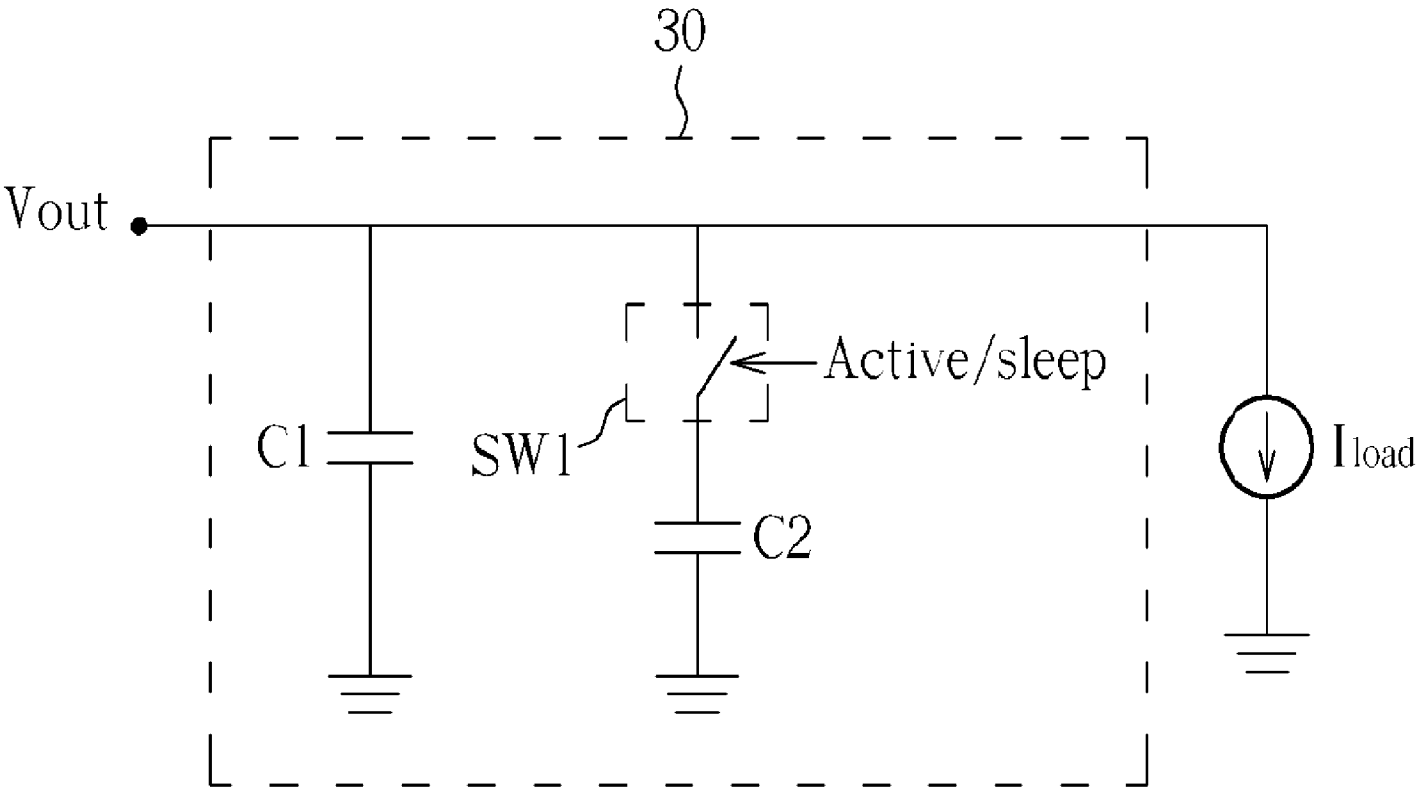
FIG. 3 is a schematic diagram of a pole control unit according to an embodiment of the present invention.

For example, when the back-end load is switched from a sleep state to an active state, the back-end load may drain a great quantity of current, i.e. the load current $I_{load}$, from the transmission element 220, so as to reduce the output impendence of the transmission element 220. In this case, if the output capacitance Cout is increased correspondingly, the pole frequency of the LDO voltage regulator 20 may be fixed to maintain the loop stability. Please refer to FIG. 3. FIG. 3 is a schematic diagram of a pole control unit 30 according to an embodiment of the present invention. The pole control unit 30 is utilized for realizing the pole control unit 240 of FIG. 2, and includes a first capacitor C1, a second capacitor C2 and a switch SW1. The first capacitor C1 and the second capacitor C2 are utilized for providing two constant capacitor values, respectively. The switch SW1 is coupled between the second capacitor C2 and the transmission element 220, and is utilized for switching in the second capacitor C2 to couple to the transmission element 220 for adjusting the output capacitance Cout according to the operation state of the back-end load.

Preferably, when the back-end load operates in an active state, the switch SW1 is short-circuited to couple the second capacitor C2 to the transmission element 220, so as to increase the output capacitance Cout. At this time, the output capacitance Cout is equal to total capacitance of the first capacitor C1 and the second capacitor C2. Conversely, when the load element enters a sleep state, the switch SW1 is open-circuited, and the output capacitance Cout is merely equal to the value of the first capacitor C1.

Therefore, in contrast to the sleep state of the back-end load, when the back-end load enters the active state, which reduces the output impedance of the transmission element 220, the switch SW1 is then switched on to couple the second capacitor C2 to the transmission element 220 in order to increase the value of the output capacitance Cout, so as to fix the pole frequency of the LDO voltage regulator 20. Consequently, the LDO voltage regulator 20 can have the same frequency response regardless of the operation state of the back-end load, so as to improve the loop instability problem resulting from the drift of the pole frequency.

Moreover, in addition to keeping the loop stability of the LDO voltage regulator 20, appropriate values of the first capacitor C1 and the second capacitor C2 may be selected to optimize transient response of the output voltage in the embodiment of the present invention.

In short, the embodiment of the present invention switches the output capacitor dynamically to compensate for the drift of the pole frequency. Thus, compared with the prior art that requires complicated circuits for implementing frequency compensation, a simple circuit can be used to realize the frequency compensation in the present invention. Please note that the above-mentioned embodiments are simply exemplary illustrations of the present invention, and that those skilled in the art can certainly make appropriate modifications according to practical demands, which all belong to the scope of the present invention as long as the function of adjusting the output capacitance is performed.

As mentioned above, the LDO voltage regulator with efficient frequency compensation is provided in the present invention, which adjusts the value of the output capacitor to fix the pole frequency according to the output impedance variation, so as to maintain the loop stability. Preferably, the present invention can be applied in the LDO voltage regulator with built-in output capacitors.

Those skilled in the art will readily observe that numerous modifications and alterations of the device and method may be made while retaining the teachings of the invention.

What is claimed is:

1. A low drop-out (LDO) voltage regulator with efficient frequency compensation, the LDO voltage regulator comprising:

an error amplifier for generating a control signal according to a reference voltage and a feedback voltage;

a transmission element coupled to the error amplifier for adjusting an input voltage to generate an output voltage according to the control signal;

a voltage divider coupled to the transmission element for performing a voltage division operation on the output voltage to generate the feedback voltage; and a pole control unit coupled to the transmission element for providing and adjusting output capacitance of the LDO voltage regulator to fix frequency of a pole according to variation of output impedance of the transmission element, so as to maintain loop stability.

2. The LDO voltage regulator of claim 1, wherein the frequency of the pole is determined by a product of the output impedance of the transmission element and the output capacitance of the LDO voltage regulator.

3. The LDO voltage regulator of claim 1, wherein the output impedance of the transmission element varies according to an operation state of a back-end load.

4. The LDO voltage regulator of claim 3, wherein the pole control unit comprises:

a first capacitor;

a second capacitor; and a switch coupled between the second capacitor and the transmission element for switching the second capacitor to couple to the transmission element for adjusting the output capacitance of the LDO voltage regulator according to the operation state of the back-end load.

5. The LDO voltage regulator of claim 4, wherein the switch is short-circuited to couple the second capacitor to the transmission element when the load element is operated in an active state, the output capacitance of the LDO voltage regulator being equal to total capacitance of the first capacitor and the second capacitor.

6. The LDO voltage regulator of claim 5, wherein the switch is open-circuited when the load element is operated in a sleep state, the output capacitance of the LDO voltage regulator being equal to capacitance of the first capacitor.

7. The LDO voltage regulator of claim 1, wherein the transmission element is a transistor.

8. The LDO voltage regulator of claim 7, wherein the transistor is a P-type Metal-Oxide-Semiconductor (MOS) Field Effect Transistor (FET).

9. The LDO voltage regulator of claim 1, wherein the voltage divider comprises a plurality of voltage dividing resistors.

* * * * *